United States Patent [19]

Balles et al.

[11] 4,133,525

[45] Jan. 9, 1979

[54] ELECTRICALLY OPERATED PLAYER CONTROLLED APPARATUS FOR PROVIDING A GAME OF SKILL

[76] Inventors: Richard Balles, 1280 Hobart Ave., Bronx, N.Y. 10461; William F. Balles, Sr., 71-14 68th Pl., Glendale, N.Y. 11227

[21] Appl. No.: 733,856

[22] Filed: Oct. 19, 1976

[51] Int. Cl.[2] ..... A63F 9/00

[52] U.S. Cl. ..... 273/1 E; 221/209

[58] Field of Search ..... 273/1 E, 142 K, 138 A; 272/31 P; 221/209

[56] References Cited

U.S. PATENT DOCUMENTS

| | | | |
|---|---|---|---|
| 3,565,426 | 2/1971 | Glass et al. | 273/1 E |
| 3,637,212 | 1/1972 | Hurley | 273/1 E |

FOREIGN PATENT DOCUMENTS

| | | | |
|---|---|---|---|
| 113378 | 7/1941 | Australia | 221/209 |
| 474037 | 10/1937 | United Kingdom | 221/209 |

*Primary Examiner*—Paul E. Shapiro

*Attorney, Agent, or Firm*—Allen R. Morganstern

[57] ABSTRACT

This invention relates to an Electrically Operated Player Controlled Apparatus for Providing a Game of Skill wherein a rotating plane member visible to the player has placed upon it objects which are to be physically removed therefrom by an arm member rotatably maneuverable across a portion of the surface of said plane member, the object being to coordinate the movement of said arm member which travels in an arc-like path above the surface of the said plane member during a period of rotation of said plane member, so as to cause one of said objects placed on said rotating plane member to be dislodged therefrom.

3 Claims, 2 Drawing Figures

ELECTRICALLY OPERATED PLAYER CONTROLLED APPARATUS FOR PROVIDING A GAME OF SKILL

BACKGROUND AND OBJECTS OF THE INVENTION

The present invention relates generally to an electrically operated player controlled apparatus for providing a game of skill, more particularly an electrically operated game of skill which requires a player to coordinate the movement of an arm member across the surface of a rotating plane member so as to cause said arm member to cross the path of an object placed upon said rotating plane member, thus causing said object to be dislodged from the surface of said rotating plane member. Although prior art games of skill have utilized a rotating plane member upon whose surface objects are placed, the present invention incorporates and utilizes a unique combination of components whereby a new and unique game of skill is created.

In conjunction with the above, it is an object of this invention to create a new and unique electrically operated player controller apparatus for providing a game of skill wherein the cycle of operation of said game is inherent within the inter-relationship of the components of the device such that the device is self-regulating as to the time interval for a cycle of operation.

It is another object of this invention to provide a new and unique electrically operated player controlled apparatus for providing a game of skill wherein a player's sensory perceptions as well as his judgment are taxed so as to create a truly challenging game of skill wherein a player must coordinate as to judgment when an object placed upon a rotating plane and thereby following a defined rotational path will intersect an arc-like path of an intersecting arm member whose path is superimposed upon said plane member.

It is another object of this invention to create a new and unique electrically operated player controlled apparatus for providing a game of skill that is rugged in construction, portable in design and free from player manipulation.

The objects and advantages of the invention are set forth in part herein and in part will be obvious herefrom, or may be learned by practice of the invention, the same being realized and attained by means of the instrumentalities and combinations pointed out in the appended claims.

SUMMARY OF THE INVENTION

Briefly described, the present invention is directed to a novel and unique electrically operated player controlled apparatus for providing a game of skill incorporating a rotating plane member that is visible to a player which has placed upon it objects which are to be physically removed therefrom by an arm member whose operation is initiated by the player, said arm member being rotatably maneuverable in an arc-like path across a portion of the surface of said plane member, the object of the game, as stated above, being to coordinate the movement of said arm member such that as it travels along its arc-like path above the surface of said plane member during a period of rotation of said plane member which has a number of objects placed upon said rotating plane member, the object of said game being to have said arm member come into contact with said objects that are placed upon said rotating plane member resulting in the dislodging of said object from the surface of said rotating plane member, thereby entitling a player to the winning of a prize.

As herein preferably embodied, a circular plane member pivotally rotatable about its center is continuously actuated. A cycle of operation is initiated by the insertion into the apparatus of a coin which triggers switching circuitry such that by the depression of a button by a player once the cycle of operation of said apparatus has been commenced, a player actuates the movement of a pivotally positioned arm member whose movement defines an arc-like path across a portion of the surface of said plane member, the said movement and arc-like path being of a continuous nature that is beyond the control of a player once said actuator button has been depressed. The arm member is of such a design that it is cantilevered over the surface of the plane member at a height sufficient to avoid contact with said objects that are placed upon said plane member and comprises an extension arm, one end of which is structurally affixed to a rotatably pivotal support means which is positioned adjacent to said plane member and the other end of said extension arm being structurally affixed at right angles to a structural member whose free end is in physical contact with the surface of said plane member.

As previously stated, the circular plane member is continuously rotating about its center. Upon the insertion of a coin into the apparatus, switching circuitry is actuated such that a player can, upon depressing a button, actuate said pivotally positioned arm member such that said arm member is caused to move over its defined arc-like path from the center of said plane member out to the edge of said plane member and back again to the center of said plane member, said movement being in one continuous motion as said plane member continues to rotate about its axis, the player attempting, by the above, to cause objects placed upon said plane member to be dislodged from the surface of said plane member during the period of movement of said arm member.

To accomplish the above, there will hereinafter be defined electrical circuitry interrelating the component parts of said apparatus.

It will be understood that the foregoing general description and the following detailed description as well are exemplary and explanatory of the invention, but are not restricted thereof.

The accompanying drawings referred to herein and constituting a part hereof, are illustrative of the invention, but not restricted thereof, and, together with the description, serve to explain the principles of the invention.

DESCRIPTION OF A PREFERRED EMBODIMENT

Figure 1:
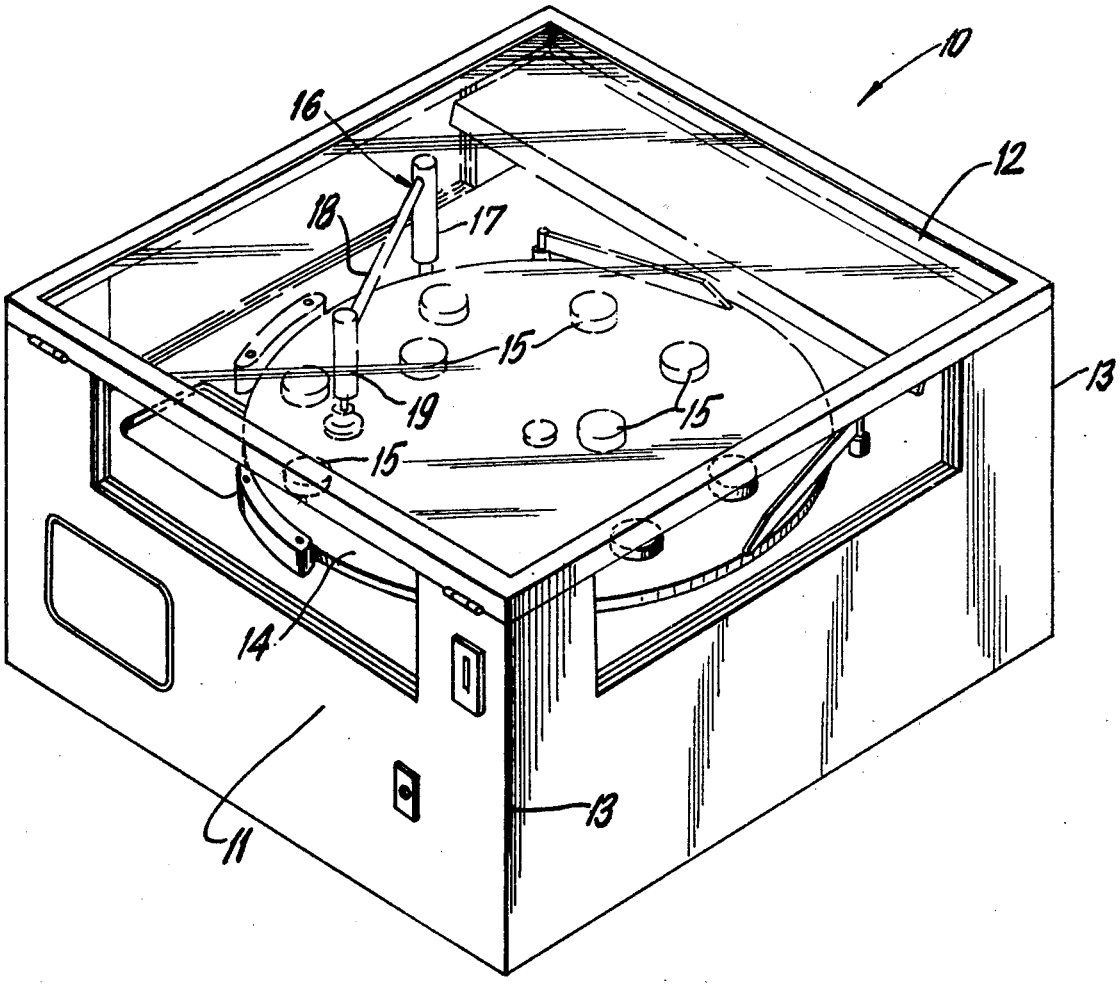
FIG. 1 is a three-dimensional perspective view of an electrically operated player controlled apparatus for providing a game of skill constructed in accordance with the invention.

Referring now more to the embodiment of the invention shown in the accompanying drawings, there is illustrated in FIG. 1 an electronically operated player controlled apparatus for providing a game of skill indicated by reference numeral 10. In accordance with the invention, electronically operated player controlled apparatus for providing a game of skill 10 comprises a housing 11 which can be of any design or shape as long as it provides an enclosed cavity into which can be mounted the component parts of the apparatus. As herein preferrably embodied in FIG. 1, said housing 11 is of a rectangular design, having a transparent cover 12 that is mounted upon corner pedestals 13 so as to provide a barrier that prevents a player from interfering with the operating of said game. As further depicted in FIG. 1, plane member 14 is pivotally mounted about its center and constantly rotates about said point in accordance with the invention.

As further depicted in FIG. 1, there is illustrated the placement of objects 15 upon plane member 14. Additionally illustrated therein is arm member 16 which comprises a rotatably pivotal support means 17 positioned adjacent to plane member 14 and perpendicular with regard thereto, extension arm 18 structurally fixed at right angles to rotatably pivotal support means 17 and parallel to plane member 14 and structural member 19 which is affixed at right angles to extension arm 18 we well as being parallel to rotatably pivotal structural member 17 and is of such a design as to provide its free end with a structure that rests upon said plane member 14 such that it can freely move across the surface of plane member 14 in response to the actuation of arm member 16.

Figure 2:
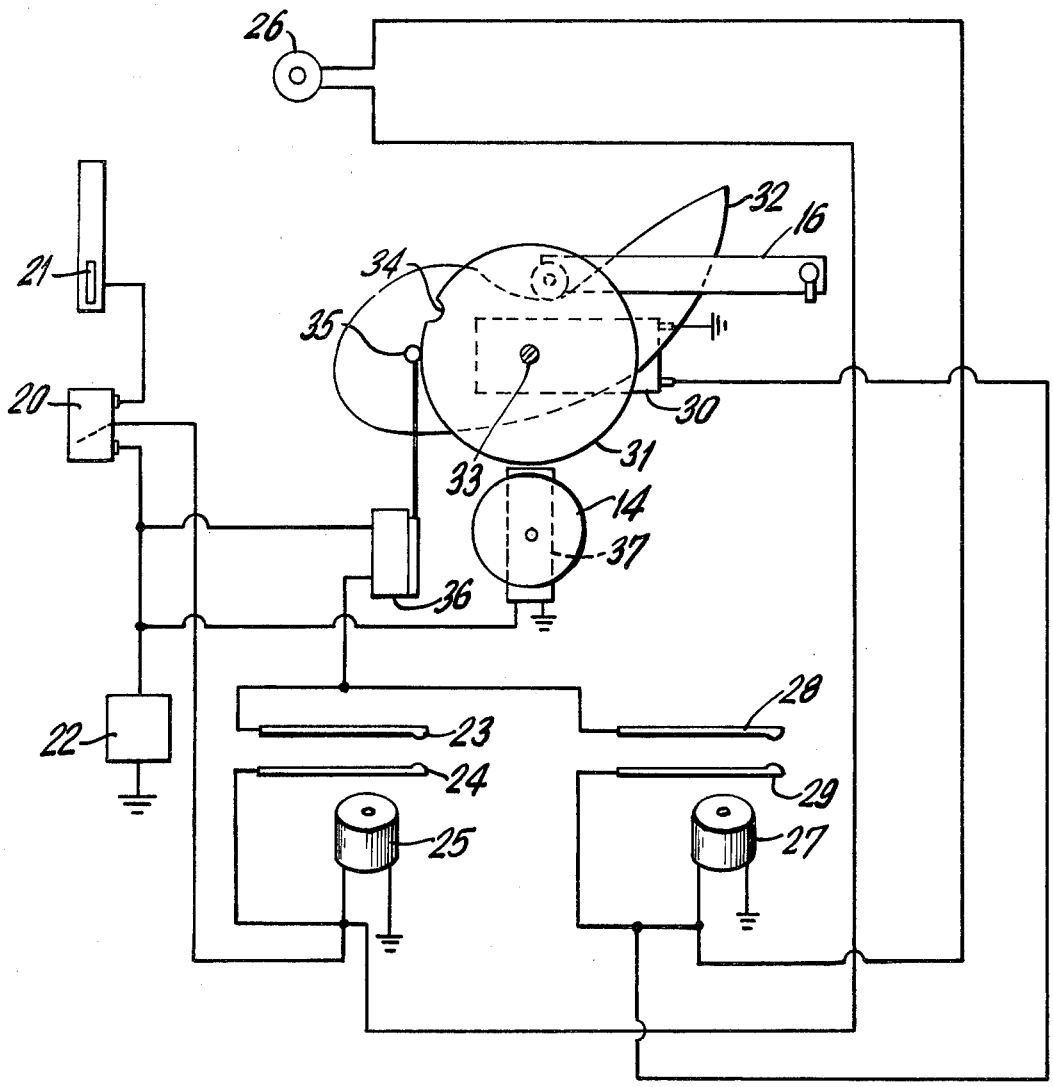
FIG. 2 is an electrical schematic setting forth in diagram form the electrical layout of a proferred embodiment of said electrically operated player controlled apparatus for providing a game of skill.

As illustrated in FIG. 2 and as illustrative of one preferred embodiment of the invention, there is depicted therein a coin actuated micro switch 20 which is actuated by the dropping into slot 21 a coin of a desired monetary value. Upon the actuation of micro switch 20 by the insertion of a coin, a circuit is then completed utilizing external power source 22 such that contact point 23 and contact point 24 close due to the fact that coil 25, upon having current supplied thereto, sets up an electromagnetic field which causes contact point 23 to physically move in the direction of contact point 24 resulting in electrical contact being established between contact points 23 and 24. Upon the closing of the gap between contact point 23 and contact point 24, electrical current is then supplied to push button 26 which represents an open circuit until depressed by a player.

As stated above, current is supplied to push button switch 26 which represents an open circuit until its depression by a player. Once depressed, however, push button switch 26 then provides for the supplying of current to coil 27 which operates identical to coil 25, the result being that coil 27 creates an electro-magnetic field causing contact point 28 to close the gap between it and contact point 29, thus providing a closed electrical path across a heretofore opened circuit. As a result of the closing of the gap across contact points 28 and 29, current is then supplied to cam motor 30 which causes the rotational movement of cam 31 and cam 32, both of which are pivotally mounted about center member 33.

Cam 32 is mechanically linked in a manner well known in the art to arm member 16 so as to cause the arc-like movement of arm member 16 from the center of plane member 14 out to its edge and then back to the center starting point all within one cycle of operation.

As herein preferrably embodied, cam 31 is structurally affixed about center member 33 and is also driven about center member 33 by cam motor 30.

Cam 31 represents the means by which the apparatus provides a timed cycle of operation which is representative of one game. More particularly, cam 31 is of a circular design having a detente portion 34. Guide 35 which is designed to physically ride the perimeter of cam 31 represents the actuating means for triggering on and off micro switch 36 such that when guide 35 detects detent portion 34 of cam 31, micro switch 36 is placed into a nonconductive mode which thereby results in the interruption of the flow of current to coils 25 and 27 causing contact points 23 and 24 and contact points 28 and 29 respectively to disconnect resulting in the discontinuance of the supply of current to cam motor 30 thus causing arm member 16 to come to rest and micro switch 20 to open, ready for the next cycle of operation.

It should further be noted that inherent in the above design, cam 31 upon having guide 35 cause micro switch 36 to open due to the detection of detent portion 34 thus interrupting the flow of current to cam motor 30 is of such a design and structure so as to have sufficient enertia created during its rotational cycle such that sufficient momentum exists so as to cause cam 31 to continue to rotate about the center member 33 for a sufficient time interval after cam motor 30 ceases to drive cam 31 such that guide 35 does not come to rest at detent portion 34.

In summary, and as representative of a cycle of operation of the preferred embodiment of this invention as depicted in FIG. 2, upon the triggering of micro switch 20 by the insertion of a coin into the apparatus through slot 21, current is supplied directly to coil 25 which in turn causes contact points 23 and 24 to close, thus providing current to push button 26. Push button 26 is controlled by a player such that upon the player's depression of push button 26, the open circuit represented by push button 26 is closed thus supplying current to coil 27 which causes contact points 28 and 29 to close thereby providing a path for current to flow from external power source 22 through closed micro switch 36, through closed contact points 28 and 29 to cam motor 30, such that cam 32 becomes actuated so as to cause arm member 16 to follow its present designed course of movement. It should be noted that once the player has pushed push button 26, said player no longer has control over the movement of the arm member 16 since coil 27 is not only actuated by current passing through push button 26 but is additionally supplied current from external power source 22 via micro switch 36 and closed contact points 28 and 29. By such a design, there is removed from the player the capability of manipulating the operation of the apparatus so as to obtain or achieve an unfair advantage during a cycle of operation.

As previously stated, plane member 14, is continuously rotating both during a cycle of operation of the apparatus as well as between said cycles, said plane member being rotatably moved by motor 36 in a manner well known in the prior art and is so utilized as a means to attract the attention of prospective players.

The preceding description and accompanying drawings relate primarily to one specific application of the invention, and the invention in its broader aspects should not be so limited to said one specific embodiment as herein shown and described, but departures may be made therefrom within the scope of the accompanying claims, without departing from the principles of the invention and without sacrificing its chief advantages.

I claim:

1. An electrically operated player controlled apparatus for providing a game of skill comprising:

(a) a plane member capable of rotational movement about its axis;

(b) an arm member rotatably maneuverable across a portion of surface of said plane member, capable of knocking from the surface of said plane member as it rotates about its axis an object placed thereon;

(c) means for causing said arm member to selectively rotatably maneuver across the surface of said plane member;

(d) a player actuated switch capable of initiating movement of said arm member;

(e) means for causing continuous rotational movement of said plane member about its axis beyond control of a player during a cycle of operation of said game; and (f) means for selectively initiating said rotatably maneuverable arm member to move across a portion of the surface of said plane member as said plane member rotates, said movement once initiated by said player being beyond said player's control to stop during the cycle of operation of said game, said means comprising:

(i) a first coil capable of closing a first pair of contact points thereby providing a closed electrical path for current to flow to said player actuated switch, said first coil being actuated upon insertion of a coin into said electrically operated player controlled apparatus;

(ii) a second coil capable of closing a second pair of contact points thereby providing a closed electrical path for current to flow to said means for causing said arm member to rotatably maneuver across the surface of said plane member after said player actuated switch and said first coil have both been actuated;

(iii) means for causing said first coil and said second coil throughout the cycle of operation of said electronically operated player controlled apparatus to remain actuated, independent of the continued actuation of said player actuated switch, thus keeping closed said first and second pairs of contact points once said first and second coils have been actuated; and (iv) means for deactuating said first and second coils thereby causing to open said first and second pairs of contact points, thus ending movement of said arm member across a portion of said plane member once a cycle of operation of said player controlled apparatus has been completed, said deactuating being beyond the control of a player.

2. An electrically operated player controlled apparatus for providing a game of skill as claimed in claim 1 wherein the means for causing said rotatably maneuverable arm member to move across a portion of the surface of said plane member is selectively actuated by a player for a defined period of time.

3. An electrically operated player controlled apparatus for providing a game of skill as claimed in claim 1 wherein the path followed by said arm member as it moves across a portion of the surface of said plane member is that of an arch.

* * * * *